United States Patent [19]

Brewer

[11] 4,099,678

[45] Jul. 11, 1978

[54] SHREDDER STRUCTURE AND IMPROVEMENTS THEREIN

[75] Inventor: John C. Brewer, Salt Lake, Utah

[73] Assignee: Garbalizer Machinery Corporation, Salt Lake City, Utah

[21] Appl. No.: 801,654

[22] Filed: May 31, 1977

[51] Int. Cl.[2] ..... B02C 18/16

[52] U.S. Cl. ..... 241/243

[58] Field of Search ..... 241/190, 191, 243, 292.1

[56] References Cited

U.S. PATENT DOCUMENTS

| | | | |
|---|---|---|---|
| 1,781,904 | 11/1930 | Jamison | 241/190 |
| 3,229,921 | 1/1966 | Hess et al. | 241/190 |
| 3,708,127 | 1/1973 | Brewer | 241/292.1 UX |
| 3,840,187 | 10/1974 | Brewer | 241/243 X |

*Primary Examiner*—Howard N. Goldberg

[57] ABSTRACT

A shredder structure and improvements therein for shredding or otherwise comminuting materials such as municipal and industrial waste, construction debris, automobile tires, and so forth, wherein there may be selectively installed structure which both delimits and constricts the travel path of incoming materials to the cutting portion of machine and which may also regulate the extent or degree of cut. Cutter bar segments disposed on the stationary cutter bars of the shredder can be inverted and/or turned end-for-end for prolonged use in the machine before edge sharpening or replacement of the segments becomes necessary, and this because only portions of the cutter bar segments will be utilized with any given segment installation, so that remaining portions and remaining edges are held in reserve for future use.

4 Claims, 7 Drawing Figures

SHREDDER STRUCTURE AND IMPROVEMENTS THEREIN

STATEMENT OF INVENTION

Broadly speaking, the present invention provides new and improved shredder structures and improvements therein, facilitating both desired cut as well as prolongation of effective use of cutter bar segments.

FIELD OF INVENTION

The present invention relates to shredding mechanisms and machines and, more particularly, to a new and improved machine and improvements therein which are useful for (1) predetermining the cutting, shredding, or comminuting of materials introduced in the shredder, and likewise for (2) protecting portions of the cutter bar segments used therein, operatively coacting with the cutter blades of the machine, whereby unused edges of such cutter bar segments may be held in reserve for subsequent use as through reversal of the segments end-for-end or simply the inversion of the same in a modified or new installation.

DESCRIPTION OF PRIOR ART

Industrial and muncipal shredders are used for a number of purposes, such as reduction of garbage and municipal waste, comminuting of construction materials, shredding of tires, and other reduction functions. The shredder will take the form of a series of blades that coact with and revolve for travel between a series of mutually spaced stationary cutter bars, these bars coacting with the blades in shredding or cutting the materials introduced therein.

The cutter bars are frequently very heavy and expensive parts and, for this reason, the inventor has previously taught and employed hardened steel cutter bar segments for coacting with the cutter blades and thereby prolonging the life of the cutter bars used. See the inventor's U.S. Pat. No. 3,578,252 which is fully incorporated herein by way of reference.

The cutter blades of whatever form, that is, whether they are joined or independent blades of multiple blade portions, will operatively revolve; the upstroke thereof is unused and requires some type of protection so that materials do not fall in this area of the shredder. A plate or baffle can be used for this purpose; more frequently, a series of webs will be employed as is shown in the inventor's U.S. Pat. No. 3,893,635, likewise fully incorporated by way of reference. These webs, which will generally have depending edge surfaces, serve not only to preclude materials from dropping into the upstroke areas of the blades but also serve as a ramp or slide down which the incoming materials will advance toward the reduction or cutting portion of the machine.

BRIEF DESCRIPTION OF THE INVENTION

The present invention has two concerns. The first is that of preserving cutter bar and cutter bar segment life by actually restricting usage of the cutter bar segments in any given installation, this by assigning only portions of such segments for operative coaction with the blade through reactive support of materials, and this so that these materials may be sheared or cut appropriately. Predetermined portions only, of cutter bar segments, are used in a given installation, the remainder of the cutter bar segments being held in reserve for future use. This is accomplished, in one embodiment, by an extension or addition to a series of depending ramps or webs installed in the machine, or elongation of such webs, such that those portions of the cutter bar segments which are nearest the axis of rotation of the blades are protected and indeed precluded from any reactive support of materials in coaction with the blades. This feature accomplishes a second purpose in actually restricting, to a predetermined length, the cuts or shear strokes in the materials being reduced. Generally, though not necessarily, these webs will be disposed above and in alignment with the cutter bars and their segments, covering segment portions, for example, one-half of the cutter bar segments, so these will not be used to reactively support, as reaction means, material which descends thereon for shredding. Of course, such webs may be displaced relative to the cutter bars; but these still advance over the central portions of the blades or areas thereabout, so that the termination of their descent effectively removes inner portions of the cutter bar segments from present coactive function relative to the blades. Thus, only half of the cutter bar segments will be used in any given installation; when the blades are inverted, top for bottom, or reversed end for end, then additional unused edges of the blade segments are available for continuing the shearing process, and this prior to the necessity of actually discarding the hardened cutter bar segments for new segments. This measurably increases the length of life of the segments as well as provide smaller, reduced piece-sizes relative to materials that are to be finally comminuted.

The structure may be designed such that two shredders are employed, one for coarse shredding, where the entire length of each segment is used, and another for fine shredding where certain segment portions are effectively removed from present operation; a single shredder machine can be used and quickly modified to change the machine from a large coarse-cutting machine to a smaller or fine-cutting machine, or vice versa.

OBJECTS

Accordingly, a principal object of the present invention is to provide a new and improved shredding machine.

A further object is to provide useful improvements in shredding machines.

A further object is to provide for a reduced cutting stroke in shredding machines by an appropriation of suitable structures or means.

A further object is to provide in a shredding machine structure for protecting portions of cutter bar segments employed such that these segments may be inverted and reversed end-for-end in succeeding operative installations, thereby preserving and prolonging length of life of the cutter bar segments.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
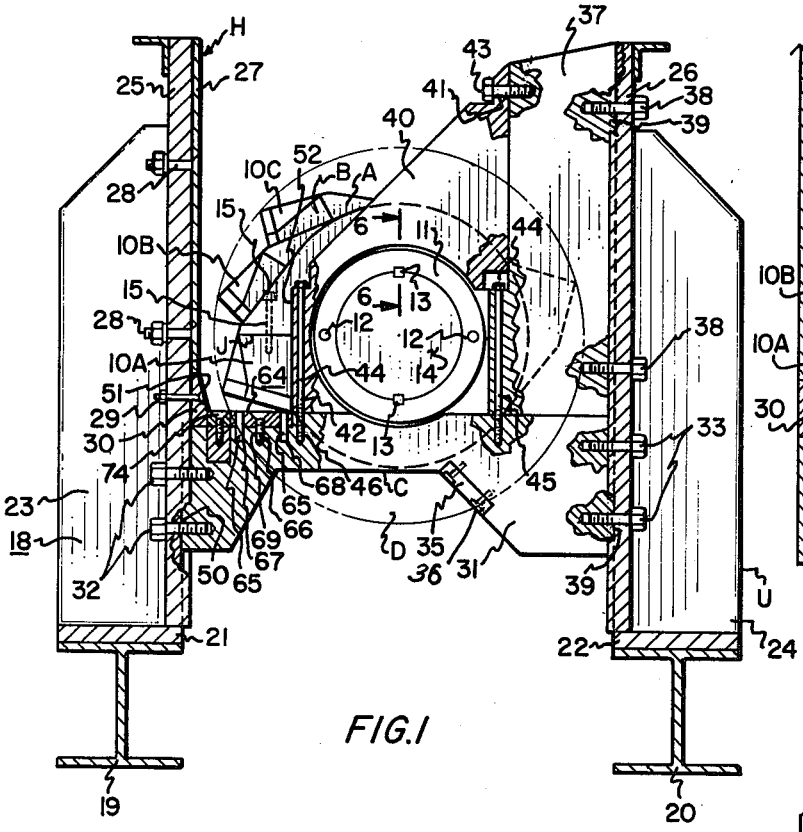
FIG. 1 is a side elevation, with the front and rear hopper enclosure sides shown removed, of a shredder structure showing various structure incorporated in the present invention.

In the drawings a series of essentially identically designed cutter blades 10A, 10B and 10C are provided, each having respective hubs 11 to which they are pinned as by pins 12, and each of the hubs 11 being keyed by key means 13 to common shaft 14. This shaft is rotated by external means such as an induction motor, not shown, such that the blades proceed in a counter-clockwise direction as shown in FIG. 1. Each of the blades preferably comprises a split blade pair having a common juncture J, the two halves A and B of each blade being bolted together by bolt means 15 in the manner shown for example in the inventor's U.S. Pat. No. 3,893,635, fully incorporated by reference. The shaft is suitably journalled by journal bearings 16 and 17 which may be mounted to base structure 18 of the shredder unit U. Such base structure will also include a pair of I-beams 19 and 20 which support steel pads 21 and 22, the latter in turn supporting respective series of upstanding, bracing webs 23 and 24, included simply for structural strength. The latter may be flush welded or simply disposed in recesses 49 prior to securement, by welding or other means, relative to side plates 25, 26 which are provided. Side plate 25 has respective, hardened steel or other inner liner 27 provided with countersunk securement attachments 28 as indicated. Insert 30 is bolted in place by attachments 29 and includes an inner chamfered or sloping surface 51 for restricting blade end clearance at the blade entrance points relative to the side wall structure, thereby urging descending materials directly to the cutter bar area of the shredder through which the blades operatively pass. The blades themselves may also take the form as shown in U.S. Pat. No. 4,059,236 by the inventor herein, and likewise fully incorporated by way of reference.

A series of cutter bars 31 are horizontally disposed and mutually spaced, and are secured in place by a series of bolts 32 and 33. These cutter bars are positioned in corresponding grooves 50 and 39 disposed in plates 25 and 26, respectively. It is noted that each of the cutter bars is relieved by a generally inverted U or V-shaped surface C, the latter formed by a general open area D in FIG. 1. This is so that the cutter blades in their trajectory will sweep past surface C so as to throw any debris clinging to the blades downwardly; any debris that remains will be cut by a cutter bar segment 35, bolted in place by attachment means 36. See the inventor's patent, U.S. Pat. No. 3,893,635, likewise incorporated herein by reference.

Support webs 37 are respectively disposed over each of the cutter bars 31 and secured in place by bolts 38, in the respective slots 39 of plate 26. Correspondingly, each respective angulated web member 40, as provided, includes apertures 41 and 42 for enabling attachments 43 and 44 to secure the respective web member 40 in place, to support-webs 37 and also to respective cutter bars 31. This is facilitated by threaded apertures 45, 46, the latter receiving bolt means 44.

Figure 3:
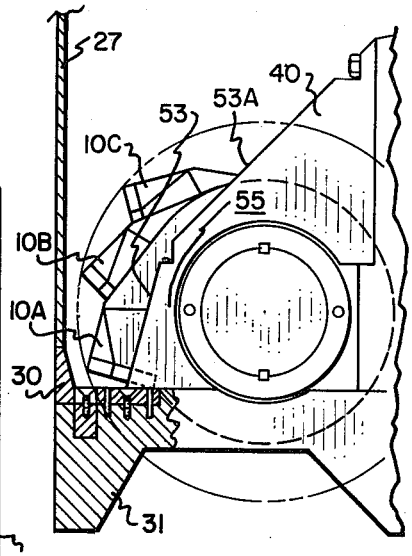
FIG. 3 is a view similar to FIG. 1 but illustrates a representative web means as having an angular extension for constraining incoming material flow to descend at outer portions only of the cutter bar segments employed, inner portions of the latter being thus protected for future use when the cutter bar segments are either inverted or rotated end for end.
Figure 2:
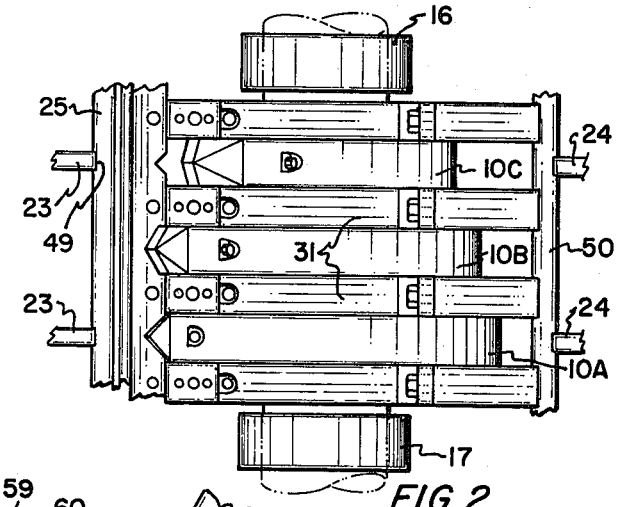
FIG. 2 is a top plan of the structure of FIG. 1.
Figure 7:
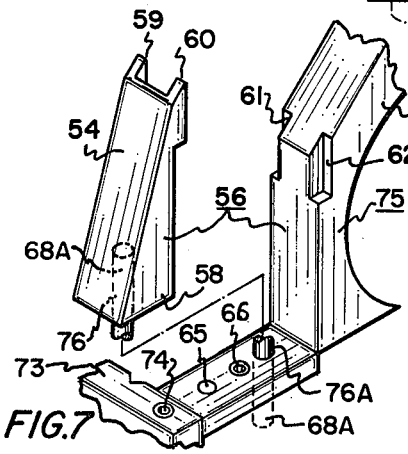
FIG. 7 is an exploded view of an alternate form of the invention wherein the angular extension of the web means comprises a separate part, being secured to a cutter bar segment and/or its cutter bar, and preferably being keyed to the remainder of a respective web.
Figure 5:
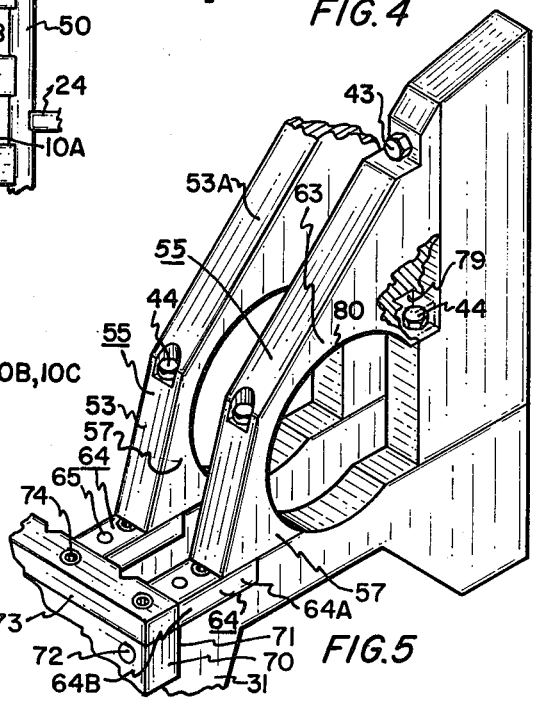
FIG. 5 is an enlarged fragmentary view of the structure of FIGS. 3 and 4, illustrating that the triangular extension of the web means employed may be integral with each web and extend half-way, for example, across the cutter bar segments associated with the mutually-spaced cutter bars of the machine.

The angulated web member may take the form shown in FIGS. 1 and 2, having a straight vertical end surface 52; but much preferably, and uniquely, substitute web members can be provided with a sloping end surface 53, as seen in connection with counterpart angulated web members 55 in FIGS. 3 and 5, or with sloping end surface 54 associated with composite angulated web members 56, one being shown in FIG. 7, respectively.

Figure 4:
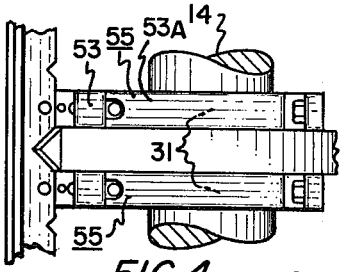
FIG. 4 is a fragmentary top plan of the structure of FIG. 3.

In FIGS. 3–5 it is seen that each of the webs or web means 55 include downwardly sloping ramp surfaces 53 which are continuations of ramp surfaces 53A. The triangularly shaped portions 57 are seen to overlap a portion, generally one-half the length, of each cutter bar segment 64 mounted on cutter bar 31. Crossbar support 70, of course, will be bolted by bolt means 72 to each of the cutter bars 31, with elongate hardened steel segment strip 73 being provided with recessed securement means 74 which are threaded into the cross-bar support 70.

The structure illustrates in FIG. 5, for example, that when the web means 55, having shaft relief apertures 80, are elongated to include the triangular portion 57, then only the outer half of the cutter bar segments, relative to the axis of shaft 14, is employed to coact as reaction means in supporting debris descending into the shredder for the cutting or shearing thereof by the shredder blades 10A–10C. Conveniently then, the angulated web members 40 in FIG. 1 may be simply replaced by web members 55 in FIG. 5 such that instead of the vertical side end surface 52, permitting a direct descent of all material over all portions of the cutter bar segments, the innermost segment portions thereof will be protected and reserved for future use. While the webs 55 are preferably aligned with and are supported by the cutter bars 31, see FIGS. 4 and 5, it will be understood that they may be displaced, and comprise a greater or lesser number of individual webs, relative to the individual cutter bars employed. What is important is that the webs serve to confine inward flow of material to be shredded to the cutting area of the machine, and also to protect or conserve the sharpened edges of the cutter bar segments so that these are reserved for future use; also to allow the blades to cut only in restricted lengths, corresponding to the used portions of the cutter bar segments, at their sharpened edges, with strip 73.

Figure 6:
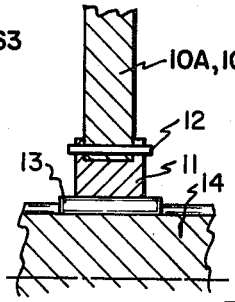
FIG. 6 is a fragmentary section, taken along the line 6—6 in FIG. 1, illustrating a means by which the hub of a respective blade assembly is keyed to the revolving shaft.

FIG. 6 simply illustrates that each of the blades 10A–10C may be keyed by a respective key 13 at the respective blade hubs 11 to shaft 14 the blade elements themselves being pinned by pin means 12 to a respective hub 11 in a conventional manner.

The structure of FIG. 7 is similar to that shown in FIG. 5, but this time the web members 75 may comprise or be substituted for web members 40 in FIG. 1, and include notches 61 and 62 for receiving ears 59 and 60 of triangularly-shaped member 58. The latter is provided with an interior aperture 76 for receiving pin 68A. Apertures 76A may be provided in the associated cutter bar segments and their cutter bars or stationary bases.

Again, if desired, the angulated web 40 in FIG. 1 may be provided with the notches or recesses 61, 62 for receiving the independent triangular member 58 of FIG. 7. Portion 63 of the web is, of course, provided with aperture 80 for receiving central passage of shaft 14.

Where desired, portion 63 may be apertured at 79 for receiving and supplying access for the head of bolt 44, the latter threading at 45 into an associated cutter bar 31. An additional cutter bar segment 35 may be employed to wipe off or shear materials impacted on the blades as they rotate again upwardly through the spaces between adjacent cutter bars 31.

Cutter bar segments 64 may likewise be made of hardened steel, having sharpened shearing edges at each of its four elongate horizontal corners. There are several ways, of course, of attaching replaceable segments to cutter bars. Preferred herein is the employment of recessed screw attachment 66 which threads into threaded apertures 69 of each of the cutter bars, see FIG. 1. Correspondingly, pins 65 at each of two places are disposed in the cutter bar segments 64 and penetrate into aligned apertures 67 and 68 in each of the respective cutter bars 31. The right-hand pin 65 may be replaced by pin 68A in FIG. 7 when the triangularly-shaped member 58 is employed.

In operation, revolvement of the shaft 14 revolves the blades 10A–10C thereon to shred materials depending into the hopper H. It is noted that inclined surfaces or ramps of web members 40 in FIG. 3, for example, serve to direct incoming materials to the cutting area of the machine. Where coarse cutting is to be made, then the structure of FIG. 1 is used; where fine cutting is to be employed, then the triangularly shaped member inserts 58 are employed or optionally, new web members 55, see FIGS. 3–5, are used in lieu of members 40. In the latter event, that is for fine shredding, only the outer half of each segment is employed as a reaction means relative to the cutter blades. The remaining halves of the segments are used when the segments are reversed end-to-end. Additionally, for fine cutting, as before explained, the length of the cut is reduced since material coming in is restricted in its fall to segment portions disposed outside of the periphery of the webs used.

What is provided, therefore, is a new shredder and improvements therein, wherein the entire cutter bar segments are employed in a coarse shredding operation or, alternatively, for fine shredding, through substitution of the web means 40 of FIG. 1 by the webs 55, or the inclusion or substitution of the structure of FIG. 7 for that of FIG. 1. For such fine shredding, the blade-cut is reduced as to length, this results in addition to the beneficial effect of having inner portions of the cutter bar segment 64 protected at portions 64A, see FIG. 5, so that descending debris will be sheared solely by those edges that are proximate outer portions 64B, holding in reserve not only the bottom edges of the cutter bar segments but also portions 64A for future use. Thus, fine shredding and reduced cuts are provided for shredder machines that are to be used in lieu of or after coarse cutting.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. A shredder including, in combination, a side plate, a journalled, revolvable shaft disposed parallel to said side plate; a series of mutually-spaced cutter blades mounted on said shaft; a series of stationary cutter bars having upper edges and being fixedly disposed with respect to said side plate; cutter bar segments releasably secured to said cutter bars, respectively, proximate said upper edges and being cooperatively disposed relative to said cutter blades, respectively; a series of webs, transversely positioned relative to said side plate, disposed over portions of respective ones of said cutter bar segments, and having upper declining edges forming with said side plate a constricting travel path for materials progressing toward said cutter bars at uncovered portions of said cutter bar segments, and wherein each of said webs comprises a stationary first web member aligned with a respective one of said cutter bars, and web means apertured to receive said shaft.

2. The structure of claim 1 wherein said web means comprises a web element having an upper, declining surface positioned over and covering a portion of a respective one of said cutter bar segments.

3. The structure of claim 1 wherein said web means comprises a second web member apertured to receive said shaft, and a third web member releasably disposed in alignment with a respective one of said cutter bars, positioned over a portion of its cutter bar segment, and keyed for alignment with said first web member.

4. In combination, a series of cutter bar blades; means for revolving said cutter blades; a series of cutter bars; means for supporting said cutter bars in stationary position; a series of reorientable cutter bar segments removably mounted on said cutter bars; and removable means for covering portions of said cutter bar segments to expose remaining portions thereof for coaction with said cutter blades in supporting materials to be shredded by said cutter blades, said removable means including a first member exposing the entire cutter blade segment of at least one of said cutter bars, and a second member releasably keyed relative to said first member and covering essentially one-half of said cutter blade segment.

* * * * *